US008474169B2

(12) United States Patent
Cottle et al.

(10) Patent No.: US 8,474,169 B2
(45) Date of Patent: Jul. 2, 2013

(54) HANDLE FOR A SEMI-AUTOMATIC FIREARM

(75) Inventors: Jeremiah Cottle, Moran, TX (US); David Compton, Abilene, TX (US)

(73) Assignee: Slide Fire Solutions, LP, Moran, TX (US)

( * ) Notice: Subject to any disclaimer, the term of this patent is extended or adjusted under 35 U.S.C. 154(b) by 377 days.

(21) Appl. No.: 12/949,002

(22) Filed: Nov. 18, 2010

(65) Prior Publication Data

US 2011/0113665 A1 May 19, 2011

Related U.S. Application Data

(60) Provisional application No. 61/262,315, filed on Nov. 18, 2009.

(51) Int. Cl.
*F41C 23/14* (2006.01)

(52) U.S. Cl.
USPC ..... 42/73; 42/75.03; 89/140

(58) Field of Classification Search
USPC ..... 42/69.01, 75.03, 106, 71.01, 72, 42/73; 89/127, 128, 129.01, 129.02, 140, 89/136
See application file for complete search history.

(56) References Cited

U.S. PATENT DOCUMENTS

| | | | |
|---|---|---|---|
| 554,068 | A | 2/1896 | Kimball |
| 981,210 | A | 1/1911 | Menteyne et al. |
| 1,587,009 | A | 1/1926 | Bobbe |
| 2,220,663 | A | 11/1940 | Rossmanith |
| 2,361,985 | A | 11/1944 | Birkigt |
| 2,465,587 | A | 3/1949 | Sampson et al. |
| 3,031,786 | A | 5/1962 | Robert |
| 3,785,243 | A | 1/1974 | Christakos |
| 4,002,101 | A | 1/1977 | Tellie |
| 4,553,468 | A | 11/1985 | Castellano et al. |
| 4,787,288 | A | 11/1988 | Miller |
| 4,803,910 | A | 2/1989 | Troncoso |
| 5,074,190 | A | 12/1991 | Troncoso |
| 5,092,052 | A | 3/1992 | Godsey |
| 5,780,762 | A | 7/1998 | Kobayashi |
| 5,852,891 | A | 12/1998 | Onishi et al. |
| 5,979,098 | A | 11/1999 | Griggs |
| 6,101,918 | A | 8/2000 | Akins |

(Continued)

OTHER PUBLICATIONS

Michael Johnson letter from US Department of Justice, Bureau of Alcohol, Tobacco, Firearms and Explosives, Jun. 26, 2008.

(Continued)

*Primary Examiner* — Benjamin P Lee
(74) *Attorney, Agent, or Firm* — Endurance Law Group, PLC

(57) ABSTRACT

A handle (20) for rapidly firing a semi-automatic firearm (22) having a trigger (24). The handle (20) includes a grip portion (52) defining a channel (54). A block (60) that is connected to the firearm (22) is slidably disposed in the channel (54) for allowing longitudinal movement of the firearm (22) relative to the handle (20). The handle (20) also includes a trigger guard (66) disposed on one side of the trigger (24) and extending longitudinally forward of the trigger (24) by a predetermined distance (D) to an open end. The trigger guard (66) presents a finger rest (70) for placing a trigger finger (74) on the trigger guard (66). The trigger guard (66) restricts access to the trigger (24) until the firearm (22) is moved longitudinally forward by the predetermined distance (D) relative to the handle (20). The handle (20) also includes a lock (44) having an open position for allowing longitudinal movement of the firearm (22) relative to the handle (20) and a locked position for restricting longitudinal movement of the firearm (22) relative to the handle (20).

23 Claims, 5 Drawing Sheets

U.S. PATENT DOCUMENTS

| | | | |
|---|---|---|---|
| 6,164,002 | A | 12/2000 | Troncoso |
| 6,807,763 | B1 | 10/2004 | Leung |
| 6,966,138 | B1 | 11/2005 | Deckard |
| 7,225,574 | B2 | 6/2007 | Crandall et al. |
| 7,273,002 | B1 | 9/2007 | Rogers |
| 7,340,857 | B1 | 3/2008 | Bentley |
| 7,398,723 | B1 | 7/2008 | Blakley |
| 7,562,614 | B2 | 7/2009 | Polston |
| 7,596,900 | B2 | 10/2009 | Robinson et al. |
| 8,051,593 | B2 | 11/2011 | Vesligaj |
| 2005/0183312 | A1 | 8/2005 | Speaks |
| 2006/0123683 | A1 | 6/2006 | Garrett et al. |
| 2010/0071246 | A1 | 3/2010 | Vesligaj |
| 2012/0042556 | A1 | 2/2012 | Vesligaj |

OTHER PUBLICATIONS

Michael Foeller II letter from US Department of Justice, Bureau of Alcohol, Tobacco, Firearms and Explosives, Jun. 18, 2008.

"[Archived Thread]—My Akins Accelerated 10/22 can kick your 10/22 ass . . . " Purported Internet discussion thread. Aug. 13-22, 2006. (Copyright); Relevant pages may include p. 3 of 5. [http://www.ar15.com/forums/t_6_11/203814_.html].

"Akins Accelerator Decision v 2.0"; Purported internet discussion thread. Jan. 9-Jun. 30, 2007. [http://thefiringline.com/forums/archive/index.php?t-234087.html].

"Another neutered Akins accelerator FS"; Purported Internet discussion thread. Jan. 19-30, 2009. [http://1919a4.com/showthread.php?21872-Another-neutered-Akins-accelerator-FS].

"ATF reverses decision . . . "; Purported internet discussion thread. Dec. 6-24, 2006. [http://www.thehighroad.org/archive/index.php/t-240357.html].

"Bill_Akins > albums > Private concepts"; Purported video posted to internet. Oct. 16, 2008. [http://good-times.webshots.com/video/301122838009976397 0axOjzH].

"Just Wanted to Show Off My Bumpfiring Toy"; Purported Internet discussion thread with embedded videos. Nov. 13, 2008-May 14, 2010; Relevant pages may include p. 1 of 2. [http://forum.saiga-12.com/index.php?/topic/31610-just-wanted-to-show-off-my-bumpfiring-toy-p/].

"More Thoughts on the Akins Accelerator"; Purported Internet discussion thread. May 29, 2008-Sep. 25, 2009. [http://armsandthelaw.com/archives/2008/05/atkins_accelera.php].

"Screw the ATF and 1022"; Purported internet discussion thread. Apr. 10-11, 2007. [http://www.thehighroad.org/archive/index.php/t-268573.html].

"Turn in Your Killer Springs Here"; Purported internet discussion thread. Jan. 9-10, 2007. [http://www.thehighroad.org/archive/index.php/t-246764.html].

Michael Foeller II letter from US US Department of Justice, Bureau of Alcohol, Tobacco, Firearms and Explosives, Jun. 18, 2008.

FIG. 7
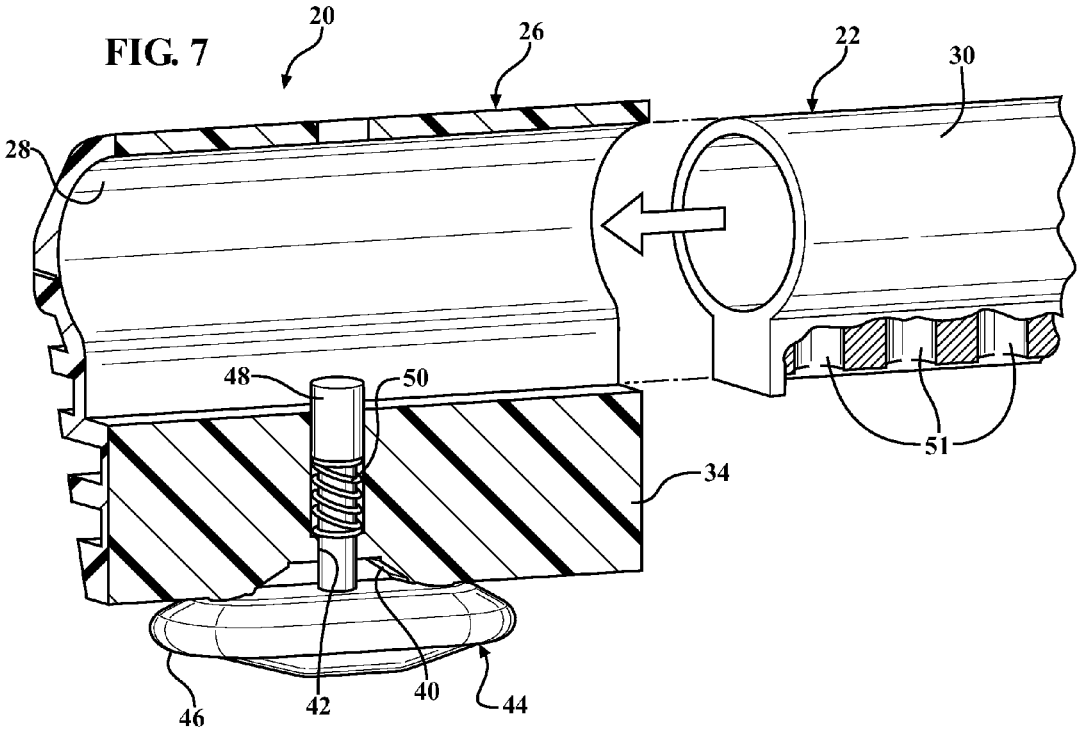
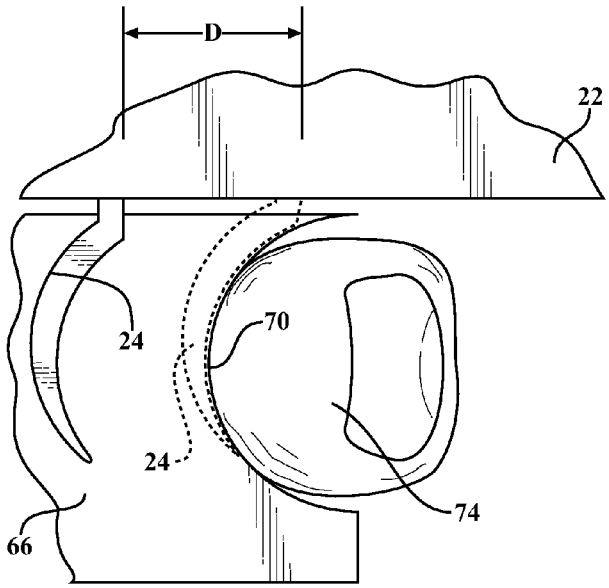
FIG. 8

HANDLE FOR A SEMI-AUTOMATIC FIREARM

CROSS REFERENCE TO RELATED APPLICATION

This application claims the benefit of application Ser. No. 61/262,315 filed Nov. 18, 2009.

BACKGROUND OF THE INVENTION

1. Field of the Invention

The present invention relates generally to firearms. Specifically, the present invention relates to a handle for attaching to the firearm to securely hold the firearm while rapidly firing and a method for firing the firearm with the handle.

2. Description of the Prior Art

Various techniques and devices have been developed to increase the firing rate of semi-automatic firearms. Many of these techniques and devices make use of the concept known as "bump firing", which is the manipulation of the recoil of the firearm to rapidly activate the trigger. One such bump firing technique is known as the "belt loop" method. To execute the belt loop method, the operator first places the firearm next to his or her hip and hooks one finger through both the trigger mechanism and a belt loop in the his or her clothing. The opposite hand is placed on the hand guard, which is attached to the barrel of the firearm. When the firearm is pushed forward by the operator, the trigger is activated by the finger to discharge a bullet. The recoil from the bullet pushes the firearm backwards away from the trigger finger, allowing the trigger to re-set. Forward force must be applied to the hand guard in order to activate the firing mechanism for each round that is fired. However, this may be achieved in very rapid succession.

Although able to achieve a high rate of firing, the belt loop has many safety and accuracy issues. For example, to correctly operate many firearms with the belt loop method, the operator's arm must be placed in the path of hot gasses being expelled from the ejection port of the firearm. This could lead to skin burns or possibly pinch the operator's sleeve or skin in the action. Another issue with the belt loop method arises because the operator cannot have a firm grip on the stock or the pistol grip of the firearm. Because the belt loop method only works if the firearm is held loosely with one hand, and the chances of the operator losing control of the firearm are greatly amplified. Because of this unnatural and unbalanced firing grip, the firearm is very difficult to aim and control during the belt loop method.

Commercial devices are also available for assisting in the bump firing concept, including the HELLSTORM 2000 and TAC Trigger. Both of these are small devices that mount to the trigger guard of the firearm and use springs to aid in quickly resetting the trigger while the firearm is bump fired, as described above. However, the same safety and accuracy issues of the belt loop method apply to these devices because the firearm cannot be held securely with the trigger hand or the stock of the firearm.

Another device for increasing the firing rate of a semi-automatic firearm is shown in U.S. Pat. No. 6,101,918, issued to Akins on Aug. 15, 2000 ("Akins '918"). Akins '918 shows a handle for rapidly firing a semi-automatic firearm having a trigger. The handle of Akins '918 extends from the stock all the way to the barrel of the firearm and a spring rod guide system supports the receiver and barrel of the firearm for longitudinal movement of the firearm relative to the handle. The handle includes a grip portion for holding the firearm.

Springs are disposed between the handle and the firearm for continuously biasing the firearm in a forward direction. The handle further includes a finger rest against which the shooter's trigger finger stops after the trigger is initially pulled. In operation, the operator places their trigger finger (typically an index finger) against a trigger and gently squeezes or pulls the trigger rearwardly to discharge a first bullet. The recoil of the firearm forces the receiver and trigger mechanism longitudinally backward relative to the handle at the same time the shooter's trigger finger lands in a stationary position against the rest. The springs are carefully sized to the ammunition so as to be easily overcome by the recoil energy of a fired bullet. Continued rearward movement of the receiver and trigger assembly under the influence of recoil creates a physical separation between the shooter's finger (now immobilized by the rest) and the trigger, thus allowing the trigger mechanism of the firearm to automatically reset. As the recoil energy subsides, the constant biasing force of the springs eventually becomes sufficient to return the receiver and trigger portions of the firearm back to the starting position without any assistance from the operator. In the meantime, if the operator's trigger finger remains immobilized while the springs push the firearm back to its starting position, the reset trigger will collide with the finger and automatically cause the firearm to discharge another round, thus repeating the firing cycle described above. So long as the shooter's finger remains in place against the rest and there is an ample supply of fresh ammunition, the firearm will continue firing rapid successive rounds without any additional human interaction or effort. One significant drawback of the Akins '918 construction is that automatic mechanisms of this type have been scrutinized for violating federal firearms laws. Another drawback is that different spring sizes (i.e., different resistance characteristics) may be required from one unit to the next depending on the type of ammunition used so that the springs do not overpower the recoil energy. This of course introduces inventory complexities.

There exists a continuing need for further improvements in devices allow the operator to practice new and interesting ways to shoot firearms in a legal and safe manner, to increase the firing rate of semi-automatic firearms without compromising the safety of the operator or the accuracy of the firearm, which are generally universally functional without respect to ammunition type, and which are sufficiently distinguished from a fully automatic weapon so as to fall within compliance of federal firearms regulations.

SUMMARY OF THE INVENTION AND ADVANTAGES

According to one aspect of the invention, a method is provided for firing a semi-automatic firearm having a trigger. The method includes the steps of: supporting the firearm in a forward pointing direction in a handle, manually moving the firearm forwardly relative to the handle by at least a predetermined distance, and restricting access to the trigger until the firearm moves forward relative to the handle by at least the predetermined distance.

According to another aspect of the invention, a semi-automatic firearm is provided. The firearm includes a trigger. A handle is provided. The handle includes grip portion, and the grip portion defines a channel. A block is configured for rigid attachment to the firearm. The block is slidably disposed in the channel for guiding longitudinal movement of the firearm relative to the handle. A trigger guard extends from the grip portion for disposition on one side of the trigger of the firearm. The trigger guard extends longitudinally forward for stabilizing a stationary object, such as a shooter's finger, to intermittently collide with the trigger in response to the firearm being moved longitudinally forward by a predetermined distance relative to the handle.

The subject invention allows the operator to maintain a stable firing form and grip while rapidly re-firing their semi-automatic firearm with little to no loss in accuracy. In contradistinction to some of the devices of the prior art, the operator must manually push the firearm forward relative to the handle to activate the trigger following each recoil event. Therefore, each discharge event of the firearm is under the uninterrupted control of the operator's human muscle power. The present invention achieves these results without any springs, cylinders, pistons, strings, wheels, or other external mechanical devices to absorb or manipulate the recoil of the firearm. The absence of external mechanical devices means that the present invention is less expensive to manufacture and less likely to fail than the prior art devices. The invention enables generally universal functionality without respect to ammunition type. Additionally, the invention fosters a unique rhythmic shooting style that will add enjoyment and excitement to the sport of shooting firearms. The subject invention can be designed for use with a wide range of semi-automatic firearm types, including both rifle and pistol styles.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 7 is a side view of the first exemplary embodiment of the lock; and

FIG. 8 is a side view of the trigger guard and a trigger; and

DETAILED DESCRIPTION OF THE INVENTION

Figure 1:
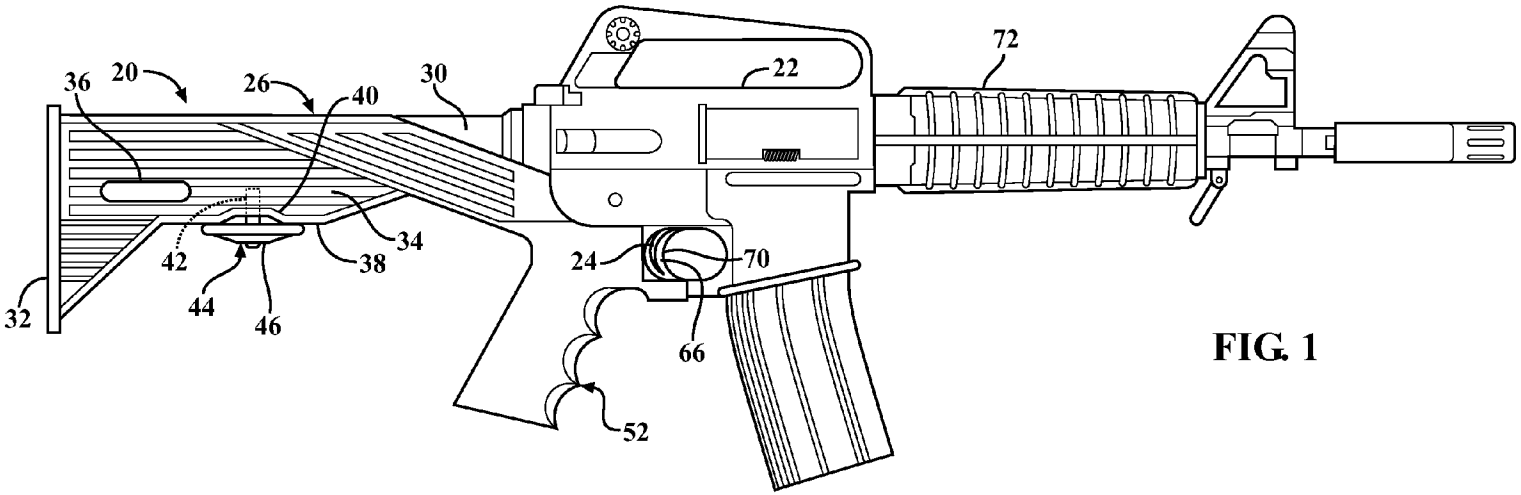
FIG. 1 is a left side view of the first exemplary embodiment of the handle supporting an AR-15 rifle.

Referring to the Figures, wherein like numerals indicate corresponding parts throughout the several views, a first embodiment of a handle 20 for supporting the receiver and barrel portions of a semi-automatic firearm 22 having a trigger 24 is generally shown in FIG. 1.

Figure 2:
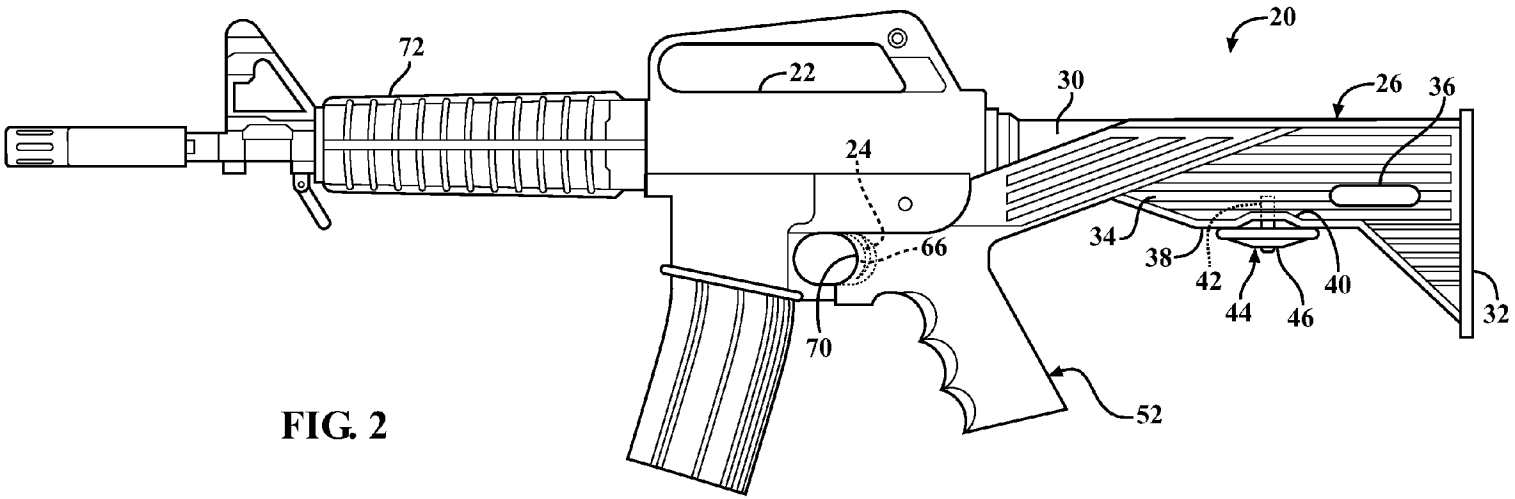
FIG. 2 is a right side view of the first exemplary embodiment of the handle supporting an AR-15 rifle.

The first embodiment of the handle 20 is for firing a semi-automatic firearm 22, shown as an AR-15 in FIGS. 1 and 2, however, any suitable semi-automatic firearm may be used with minor modifications. The handle 20 includes a stock portion 26 (generally indicated) defining a buffer cavity 28 having a generally tubular shape for slidably receiving a buffer tube 30 of the semi-automatic firearm 22. Of course, the shape of the buffer cavity 28 will be modified to accommodate the particular type of semi-automatic firearm 22 used. One end of the stock portion 26 of the handle 20 presents a butt end 32 for abutting the shoulder of an operator when the firearm 22 is raised to a firing position. The stock portion 26 also defines a vertical rib 34 extending vertically downwardly from the buffer cavity 28 and longitudinally along the stock portion 26 for structurally supporting the stock portion 26. To make the firearm 22 easier to carry, the vertical rib 34 of the exemplary embodiment presents a sling attachment point 36 for attaching a sling to the handle 20.

The stock portion 26 further defines a horizontal rib 38 extending along the bottom of the vertical rib 34 for providing additional structural support to the stock portion 26. The horizontal rib 38 further defines a recessed portion 40, and a bore 42 extends vertically from the recessed portion 40, through the vertical rib 34, and into the buffer cavity 28.

Figure 3:
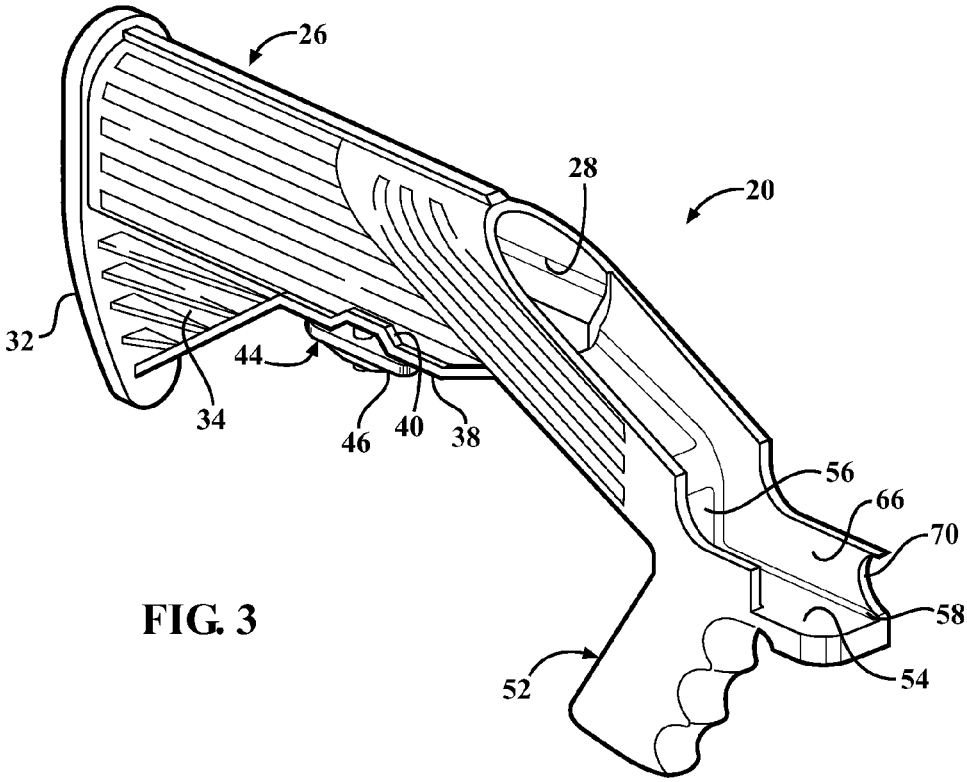
FIG. 3 is a perspective view of the first exemplary embodiment of the handle with the lock in a locked position.
Figure 4:
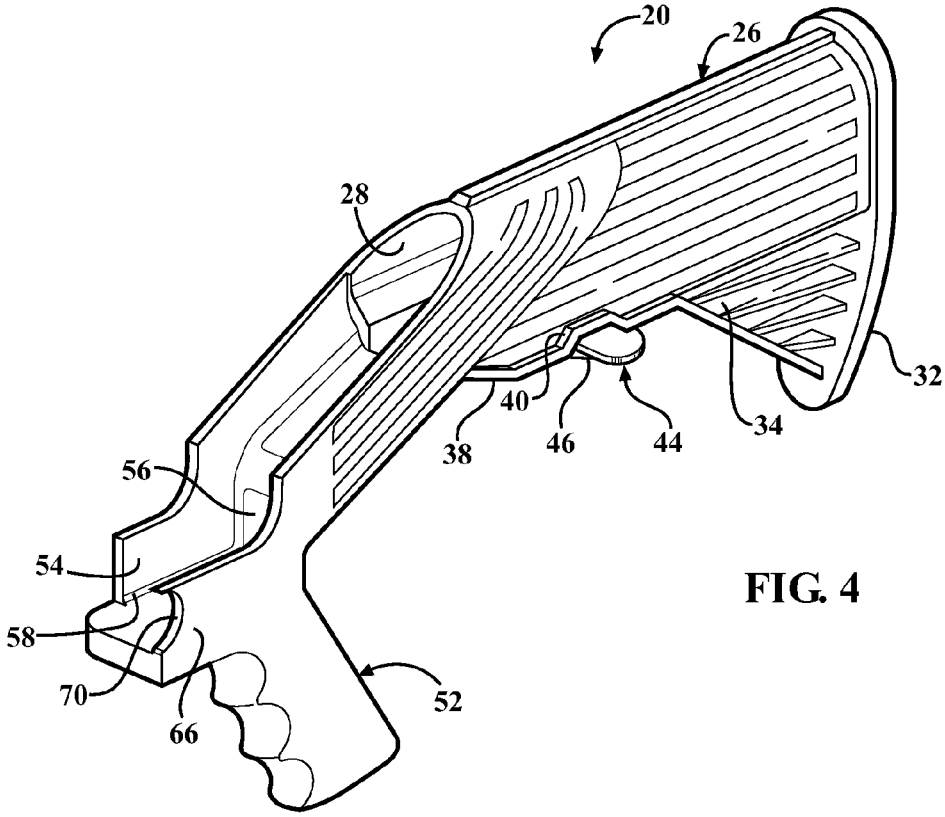
FIG. 4 is a perspective view of the first exemplary embodiment of the handle with the lock in an open position.

The handle 20 further includes a lock 44 having an open position for firing the firearm 22 in a bump fire mode and a locked position for firing the firearm 22 in a traditional or standard fire mode. In the open position, as shown in FIG. 4, the lock 44 allows longitudinal movement of the firearm 22 relative to the stock portion 26. In the locked position, as shown in FIG. 3, the handle 20 is locked to the firearm 22 to prevent longitudinal movement of the firearm 22 relative to the stock portion 26. The lock 44 of the first exemplary embodiment includes a cam 46 with a pin 48 extending perpendicularly away from the cam 46 into the bore 42 of the stock portion 26. As best shown in FIG. 7, the lock 44 also includes a spring 50 for biasing the cam 46 against the horizontal rib 38 of the stock portion 26. In the open position, as shown in FIG. 4, the cam 46 extends parallel to the horizontal rib 38 and covers the recessed portion 40 of the horizontal rib 38 to vertically space the pin 48 from the buffer tube 30 of the firearm 22. In other words, the cam 46 is turned such that interaction with the horizontal rib 38 forces a gap between the cam 46 and the recessed portion 40 of the horizontal rib 38. In the locked position, the cam 46 is turned perpendicularly relative to the horizontal rib 38, and the cam 46 is nestled into the recessed portion 40. This, in turn, causes the pin 48 to move vertically upwardly to engage a hole or detent 51 in the buffer tube 30 of the firearm 22 and thereby prevent longitudinal movement of the firearm 22 relative to the handle 20. It will be understood by those of skill in the art that buffer tubes 30 commonly include a row of holes or detents 51 for aligning with the length of the shoulder stock portion of a prior art firearm. The lock 44 provides the operator with an extremely simple and quick way to switch between the bump fire mode and the standard fire mode.

The first exemplary embodiment further includes a grip portion 52 (generally indicated) connected to the stock portion 26 of the handle 20 and extending downwardly therefrom. The grip portion 52 defines a channel 54 having an open front and a closed back 56 and presents a pair of opposing grooves 58. It should be appreciated that the grip portion 52 of the handle 20 could take many different forms. For example, in an alternative embodiment, the grip portion 52 could take the shape of the neck-like region of the stock portion 26 just behind the trigger 24 of the firearm 22, typical in hunting rifles.

Figure 5:
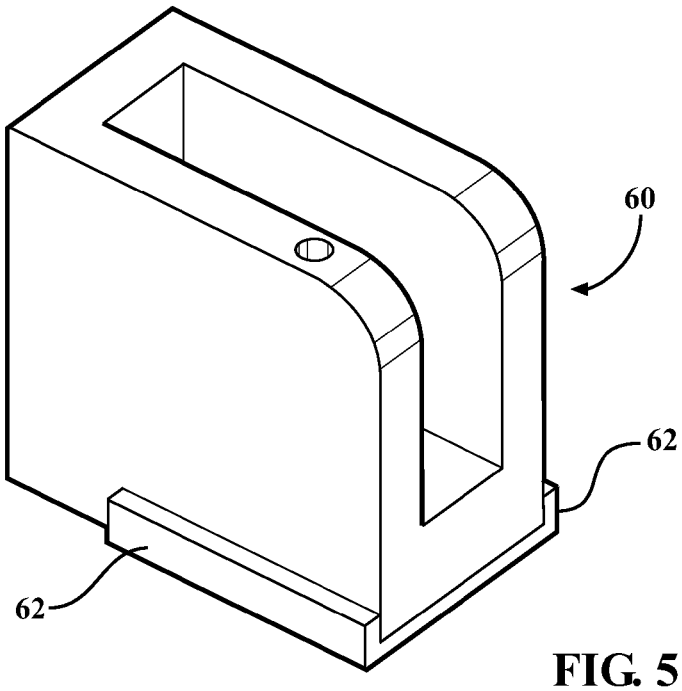
FIG. 5 is a front perspective view of the block.
Figure 6:
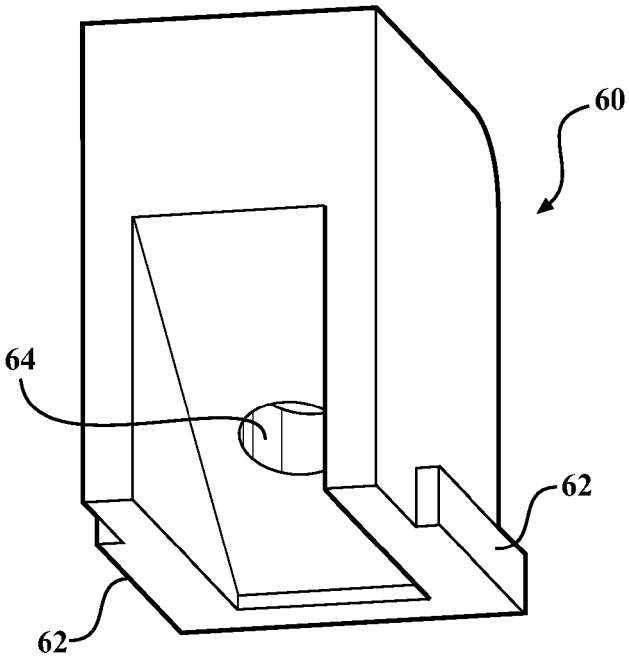
FIG. 6 is a rear perspective view of the block.

A block 60, generally shown from two perspectives in FIGS. 5 and 6, is slidably disposed in the channel 54 and presents a pair of opposing ridges 62 extending horizontally outwardly into the grooves 58. The block 60 is attached to the firearm 22 behind the trigger 24 assembly of the firearm 22. When the lock 44 is in the locked position with the pin 48 engaging the detent 51 or hole in the buffer tube 30, the interconnected block 60 and firearm 22 cannot slide in the channel 54. However, when the lock 44 is in the open position, the block 60 is free to slide in the channel 54, and thus the firearm 22 is free to move longitudinally relative to the handle 20. As shown in FIG. 6, the block 60 also includes an aperture 64, and a screw, bolt, or stud extends through the aperture 64 to engage the firearm 22. It should be appreciated that the block 60 could take many different forms in order to accommodate different rifles or other firearms. When the firearm 22 is operated in the bump fire mode, the block 60 acts as a bearing or a bushing, to facilitate the longitudinal movement of the firearm 22 relative to the handle 20.

The handle 20 further includes a trigger guard 66 extending longitudinally forward from the grip portion 52 for disposition on one side of the trigger 24 of the firearm 22. The trigger guard 66 extends longitudinally forward of the trigger 24 to an open end for receiving a finger or other stationary object to activate the trigger 24 in response to the firearm 22 being moved longitudinally forward by a predetermined distance D relative to the handle 20. The predetermined distance D is generally equal to the stroking distance required to fully reset the trigger 24 so that the firearm 22 can be fired again. The relative sliding distance between the block 60 and the channel 54 is at least equal to, but preferably greater than, the predetermined distance D. In the exemplary embodiment of FIG. 1, the trigger guard 66 presents a finger rest 70 at the open end for holding a finger in a generally stationary position. Alternatively to the operator's finger, a cross-pin or any other comparable object could be placed at the end of the trigger guard 66. The trigger guard 66 is only disposed on one side of the trigger 24 so that the trigger 24 can be accessed on the other side of the firearm 22 for firing the firearm 22 in the standard firing mode, as will be discussed in greater detail below. In this manner, the trigger guard 66 restricts or otherwise impedes access to the trigger 24, but in the preferred embodiment does not prevent access altogether.

The stock portion 26, grip portion 52, and block 60 are preferably made of a glass filled nylon, a polymer filled nylon, carbon fiber, metal, or any other material strong enough to withstand repeated discharges of the gun over time. The pin 48 and the spring 50 are preferably made of metal, but other materials may also be used. Injection molding is the preferred manufacturing process of the handle 20, but casting, machining, or any other manufacturing process may also be employed depending, at least in part, on the specific material used.

Installation of the first exemplary embodiment of the handle 20 is very simple. On AR based rifles 22, like the one shown in the handle 20 of FIGS. 1 and 2, the manufacturer's shoulder stock is first removed from the buffer tube 30. Next, the manufacturer's pistol grip is removed using an allen wrench or other suitable tool. The block 60 is then mounted onto the firearm 22 where the pistol grip was previously mounted with a screw, bolt, stud, or any other suitable fastener. Once the block 60 has been mounted onto the firearm 22, the buffer tube 30 of the firearm 22 is slid into the buffer cavity 28 of the stock portion 26 of the handle 20. Simultaneously, the ridges 62 of the block 60 are guided into the grooves 58 of the channel 54 to slidably support the firearm 22 within the handle 20. The lock 44 may now be rotated to the position shown in FIG. 3 to put the firearm 22 in the standard fire mode or the lock 44 to the position shown in FIG. 4 to put the firearm 22 in the bump fire mode.

Although the first embodiment of the handle 20 is shown mated with an AR-15 rifle 22, it should be appreciated that with minor geometrical changes, the handle 20 may be mounted to other types of semi-automatic firearm, including both rifles and pistols.

In the bump fire mode, human muscle effort is used to push the firearm 22 forward while the handle 20 is held generally stationary, preferably also with an opposing human muscle effort somewhat akin to an isotonic exercise movement. In the preferred embodiment, the operator places one hand on a hand guard 72 attached to the barrel of the firearm 22 and the other hand on the pistol grip of the handle 20 with the butt end 32 of the stock portion 26 of the handle 20 butted up against the shoulder of the operator. Of course, other configurations of the invention are conceivable in which a single hand is used to supply the human effort needed to both push the firearm 22 forward and hold the handle 20 stationary. This may be accomplished by suitable lever mechanisms or other manually controlled devices. In the case of a handicapped operator that does not have use of one or perhaps even both arms, the device may be configured to allow a operator to apply other forms of muscle effort, such as from a leg, neck, or torso. In all such cases, it is preferred that human muscle effort is the primary (if not exclusive) source of energy for moving the firearm 22 forward against the recoil energy of a fired bullet. The act of holding the handle 20 stationary may, if desired, be accomplished by a fixed mounting arrangement such as to a shooting table or rest. The optional stationary mounting configuration may be preferred by disabled sportsmen, for example, as a convenience. Amputees, quadriplegics, and others that may be challenged to manipulate objects requiring the use of their fingers previously had limited options to assist them when operating a firearm. The subject invention enables these individuals to operate the firearm 22 without the need to manipulate small and delicate parts as was typical in prior art shooting systems.

Returning again to the most typical applications of this invention, the operator shoulders the firearm 22 or otherwise positions the firearm 22 to be fired at an intended target. At this stage, the firearm 22 and handle 20 are manually compressed together so that the trigger 24 is recessed behind the finger rest 70. When the operator (i.e., the shooter) is ready to discharge a round, he or she firmly places a finger 74 in the scalloped portion of the finger rest 70 of the trigger guard 66. Any applicable safety switch is moved to a FIRE condition, and then the operator applies human effort to push the hand guard 72 of the firearm 22 longitudinally forward so as to move the firearm 22 forward relative to the handle 20. Simultaneously with this action, the operator securely holds the handle 20 (or it is held in place by a suitable mount) so that it does not move together with the firearm 22. All the while, the operator's finger 74 is held fast against the rest 70. The trigger guard 66 holds finger 74 away from the trigger 24 until the firearm 22 travels forwardly the predetermined distance D, at which point, the trigger 24 collides with the finger 74 in the finger rest 70, thereby activating the trigger 24 and discharging a bullet from the firearm 22. As explained above, a cross-pin or any other comparable object could be substituted for the finger 74 for activating the trigger 24. Since there is no movement of the operator's finger 74 during bump firing, the intentional forward movement of the firearm 22 is considered responsible for triggering the fire control mechanism of the firearm 22. In other words, the muscular application of force to create forward movement of the firearm 22 defines the volitional act of the shooter to discharge each individual round of ammunition. Each discharge requires a separate volitional decision of the operator to exert his or her body strength to move the firearm 22 back to a firing condition.

The discharge of the bullet creates a recoil in the firearm 22 that pushes the firearm 22 longitudinally backward relative to the handle 20, thereby resetting the trigger 24. The firearm 22 stops moving backward as soon as the recoil energy subsides to the point at which it is counterbalanced by the human effort that is urging the firearm 22 forwardly, such as by a hand pushing the hand guard 72 forwardly. In any event, the firearm 22 will stop moving backward if the block 60 strikes the back 56 of the channel 54 of the grip portion 52. Because the trigger 24 has been reset automatically during backward travel of the firearm 22, the operator's muscle power pushing the hand guard 72 of the firearm 22 forwardly will bring the trigger 24 and finger 74 back into collision and cause the firearm 22 to discharge another round of ammunition.

As can thus be predicted, in the bump fire mode, a fairly rapid rate of firing the firearm 22 can be achieved by rhythmically applying a forward force on the hand guard 72 of the firearm 22. However, this forward force must not be so great as to overcome the recoil force generated by expanding gases in the discharged bullet. For example, if a particular bullet creates a recoil energy of 15 lbf in the firearm 22, then the forward force applied to the hand guard 72 must be less than 15 lbf so that the firearm 22 is able to move backward by the predetermined distance D and allow the trigger 24 to reset. If the operator applies a forward force on the hand guard 72 greater than 15 lbf in this example, then the firearm 22 will not slide rearwardly by any appreciable distance and the trigger 24 will not reset. In other words, the operator will have overpowered the recoil energy from the discharge.

An experienced user of this invention thus will develop a new and interesting shooting form by which their human muscle effort applied to separate the rifle 22 and handle 20 will be temporarily decreased substantially simultaneously with the recoil of the firearm 22, thereby allowing the firearm 22 to slide backward in the handle 20 so that the trigger 24 has a chance to reset. If the user decides to decrease their application of muscular force to zero or nearly zero during the recoil event, the firearm 22 will slide rearwardly quite rapidly with the block 60 arresting movement when it bottoms in the channel 54. Naturally, this is not a recommended way to operate the firearm 22 because the service life of the components may be reduced with hash impacts. Once the trigger 24 is reset, the user will then increase their muscle effort to separate the rifle 22 and handle 20 and thereby rapidly return the firearm to a firing condition.

In the preferred or recommended method of bump firing according to the principles of this invention, the operator's application of muscular force to separate the rifle 22 and handle 20 will fluctuate between a minimum value during the recoil event and a maximum value commencing as soon as the trigger 24 has moved the predetermined distance D. The minimum value will provide a degree of resistance to the recoiling firearm 22 sufficient to arrest its rearward movement before the block 60 bottoms in its channel 54 but not so great as to prevent full resetting of the trigger 24. The maximum value must be large enough to return the firearm 22 to a firing condition while maintaining full and graceful control of the firearm 22. In this way, a rhythmic shooting style can be learned that adds a new enjoyment and excitement to the sport of shooting firearms, and which remains under uninterrupted control of human muscle power. In other words, if at any time during the bump firing mode an operator does not apply sufficient effort to separate the rifle 22 and handle 20, the firearm 22 will immediately cease firing thus making the bump firing mode of operation dependent on an actively engaged operator.

Because the shooter will intuitively learn to adjust the effort applied to separate the rifle 22 and handle 20 in bump-fire mode, the type of ammunition used will not affect the functionally of the subject invention. As an example, it is well known that an three otherwise identical AR-15 style semi-automatic firearms 22 can be chambered for different calibers, such as .223, 7.62×39, 9 mm. Each of these ammunition types will produce a substantially different amount of recoil energy. However, the same handle 20 of the subject invention can be fitted to all three of these firearms 22, without alteration, and operate flawlessly in bump-fire mode with the only change being slight variations in muscle effort applied by the shooter in response to the varying recoil energies produced by the three separate rounds of ammunition. The invention thus introduces an opportunity for new muscle control techniques in the shooting arts that can be fostered with practice so as to develop previously unknown skills and nuances. The novel shooting method of this invention, which includes manually moving the firearm 22 forwardly relative to the handle 20 by the predetermined distance D, has the potential to invigorate the shooting sports with new interest, competitions, discussion forums and fun.

FIG. 8 shows a side view of the trigger guard 66 and the trigger 24 while the firearm 22 is operated in the bump fire mode. The solid lines show the trigger 24 in a first position after the recoil has pushed the firearm 22 longitudinally backward to the point where the block 60 has struck the back 56 of the channel 54. The dashed lines show the trigger 24 in a second position after the firearm 22 has been pushed longitudinally forward relative to the handle 20 by the predetermined distance D to collide the trigger 24 with the operator's finger 74. In other words, the predetermined distance D is the distance that the trigger 24 moves from the first position to the second position. It should be appreciated that the block 60 and buffer tube 30 also move longitudinally forward and backward relative to the handle 20 by the predetermined distance D when the firearm 22 is fired in the bump fire mode. It should be understood that in bump fire mode, the shooter's own application of longitudinally forward movement is primarily, if not solely, responsible for activating the firing mechanism. The operator's finger 74, or other stationary object, performs no volitional action during bump firing but rather acts as a dumb link in the firing cycle. In other words, a person with a paralyzed trigger finger 74 is able to bump fire a firearm 22 according to this invention with equal effectiveness as would a shooter having normal dexterity in their trigger finger 74. This is because the operator's trigger finger 74 does not squeeze the trigger 24 during the bump firing mode; it is merely held firmly against the rest 70.

To switch to the standard fire mode, the operator simply changes the lock 44 from the open position to the locked position. The operator may now place the butt end 32 of the stock portion 26 firmly against his or her shoulder. The trigger 24 is accessible on the side opposite the trigger guard 66. Because the handle 20 and firearm 22 are locked together by the lock 44, the trigger 24 cannot travel longitudinally forward to collide with the operator's finger 74. The operator's finger 74 must be placed directly on the trigger 24, and a longitudinally backward pressure must be applied on the trigger 24 to discharge the firearm 24.

Figure 9:
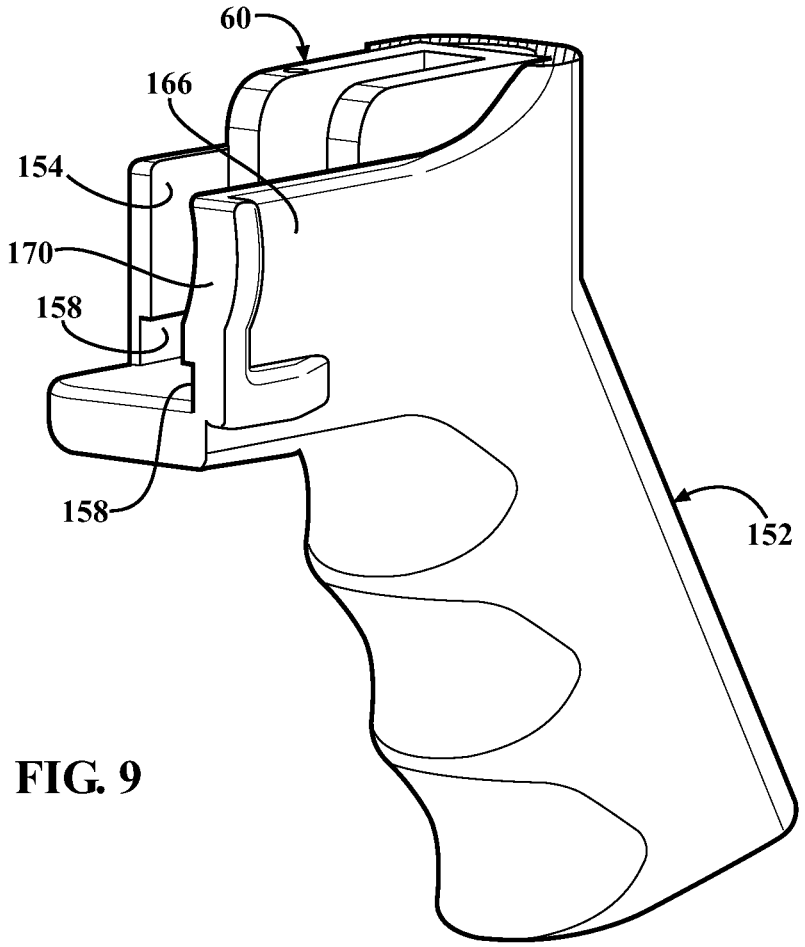
FIG. 9 is a perspective view of an alternative pistol-grip embodiment of the handle.

FIG. 9 shows a second embodiment of the handle 120 for use with a semi-automatic hand gun. The second embodiment lacks the stock portion 126 of the first embodiment but includes a grip portion 152 defining a channel 154, a block 60 slidably disposed in the channel 154, and a trigger guard 166 for predisposition in longitudinally forward of the trigger 124 of the hand gun. Similar to the first embodiment, the channel 154 of the second embodiment includes grooves 158 for receiving the ridges (not shown) in the block 60. the trigger guard 166 also includes a finger rest 170 for holding a finger in a generally stationary position. The second embodiment may also include a lock so that it can function in either a bump fire mode or a standard fire mode.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

ELEMENT LIST

| Element Symbol | Element Name |
|---|---|
| 20 | handle |
| 22 | firearm |
| 24 | trigger |
| 26 | stock portion |
| 28 | buffer cavity |
| 30 | buffer tube |
| 32 | butt end |
| 34 | vertical rib |
| 36 | sling attachment point |
| 38 | horizontal rib |
| 40 | recessed portion |
| 42 | bore |
| 44 | lock |
| 46 | cam |
| 48 | pin |
| 50 | spring |
| 51 | detent |
| 52 | grip portion |
| 54 | channel |
| 56 | closed back |
| 58 | grooves |
| 60 | block |
| 62 | ridges |
| 64 | aperture |
| 66 | trigger guard |
| 70 | finger rest |
| 72 | hand guard |

What is claimed is:

1. A handle assembly configured for reciprocating movement on a semiautomatic firearm having a trigger, said handle assembly comprising:

a shoulder stock having a rearwardly facing butt end adapted to be pressed into the shoulder of a user, a pistol grip adapted to be grasped by the user's hand, a finger rest configured to stabilize the end of a user's trigger finger stretched in front of a trigger of the firearm while the remaining fingers of the user's hand clench said pistol grip, said shoulder stock and said pistol grip and said finger rest fixed together as a moveable unit, and a lock selectively moveable between unlocked and locked conditions for respectively permitting or preventing reciprocating movement of said shoulder stock and said pistol grip and said finger rest relative to the firearm trigger;

wherein said lock includes a retractable pin, and wherein said lock includes a cam acting between said retractable pin and said shoulder stock.

2. The handle assembly of claim 1, wherein said finger rest includes a concave open end establishing a cradle for the user's trigger finger.

3. The handle assembly of claim 1, wherein said lock includes a spring acting between said retractable pin and said shoulder stock.

4. The handle assembly of claim 1, wherein said shoulder stock has an undersurface, said undersurface including a recessed portion.

5. The handle assembly of claim 4, wherein said cam is directly engageable with said recessed portion.

6. The handle assembly of claim 5, wherein said cam comprises a rotary cam.

7. The handle assembly of claim 6, wherein said recessed portion of said shoulder stock is configured to produce maximum displacement of said retractable pin within less than 180 degrees of rotation.

8. The handle assembly of claim 1, wherein said cam comprises a rotary cam coupled to said retractable pin such that rotational displacement of said cam causes said pin to be maintained in an axially displaced condition.

9. The handle assembly of claim 1, further including a cavity extending at least partially through said shoulder stock.

10. The handle assembly of claim 9, wherein said cavity includes a front mouth opening, said cavity haying a generally continuous cross-sectional inner profile extending rearwardly from said mouth opening toward said butt end of said shoulder stock.

11. A handle assembly for a semi-automatic firearm having a trigger, said assembly comprising:

a pistol grip adapted to be grasped by the user's hand, a finger rest extending forwardly from said pistol grip and configured to stabilize the end of a user's trigger finger stretched in front of a trigger of the firearm while the remaining fingers of the user's hand grasp said pistol grip, said pistol grip and said finger rest fixed together as a moveable unit, and a lock selectively moveable between unlocked and locked conditions for respectively permitting or preventing reciprocating movement of said pistol grip and said finger rest relative to the firearm trigger;

wherein said lock includes a retractable pin and a rotary cam fixed relative to said retractable pin such that rotation of said cam causes a corresponding axial displacement of said pin.

12. The handle assembly of claim 11, wherein said finger rest includes a concave open end establishing a cradle for the user's trigger finger.

13. The handle assembly of claim 11, wherein said lock includes a spring, effective to generate a spring, force acting against said retractable pin.

14. The handle assembly of claim 11, further including a shoulder stock having a rearwardly facing butt end adapted to be pressed into the shoulder of a user.

15. The handle assembly of claim 14, further including a cavity extending at least partially through said shoulder stock.

16. The handle assembly of claim 15, wherein said cavity includes a front mouth opening, said cavity having a generally continuous cross-sectional inner profile extending rearwardly from said mouth opening toward said butt end of said shoulder stock.

17. A handle assembly for a semi-automatic firearm having a trigger, said assembly comprising:

a shoulder stock having a rearwardly facing butt end adapted to be pressed into the rearward shoulder of a user, a cavity extending forwardly through at least a portion of said shoulder stock, said cavity having front mouth opening, said cavity having a generally continuous cross-sectional inner profile extending rearwardly from said mouth opening toward said butt end of said shoulder stock, a grip adapted to be grasped by the user's rearward hand, a finger rest extending forwardly of said grip and configured to stabilize the end of a user's trigger finger stretched across a trigger of the firearm while the remaining fingers of the user's rearward hand grasp said grip, said shoulder stock and said grip and said finger rest fixed together as a moveable unit, and a lock selectively moveable between unlocked and locked conditions for respectively permitting or preventing reciprocating movement of said shoulder stock and said grip and said finger rest relative to the firearm trigger;

wherein said lock includes a retractable pin, and wherein said lock includes a cam acting between said retractable pin and said shoulder stock.

18. The handle assembly of claim 17, wherein said lock includes a spring acting between said retractable pin and said shoulder stock.

19. The handle assembly of claim 17, wherein said shoulder stock has an undersurface, said undersurface including a recessed portion, said cam being directly engageable with said recessed portion.

20. The handle assembly of claim 19, wherein said cam comprises a rotary cam.

21. The handle assembly of claim 20, wherein said recessed portion of said shoulder stock is configured to produce maximum displacement of said retractable pin within less than 180 degrees of rotation.

22. The handle assembly of claim 17, wherein said cam comprises a rotary cam coupled to said retractable pin such that rotational displacement of said cam causes said pin to be maintained in an axially displaced condition.

23. The handle assembly of claim 17, wherein said finger rest includes a concave open end establishing a cradle for the user's trigger finger.

* * * * *

US008474169C1

(12) EX PARTE REEXAMINATION CERTIFICATE (10858th)

United States Patent
Cottle et al.

(10) Number: US 8,474,169 C1
(45) Certificate Issued: Apr. 28, 2016

(54) HANDLE FOR A SEMI-AUTOMATIC FIREARM

(75) Inventors: Jeremiah Cottle, Moran, TX (US); David Compton, Abilene, TX (US)

(73) Assignee: SLIDE FIRE SOLUTIONS, LP, Moran, TX (US)

Reexamination Request:
No. 90/013,631, Nov. 17, 2015

Reexamination Certificate for:

| | |
|---|---|
| Patent No.: | **8,474,169** |
| Issued: | **Jul. 2, 2013** |
| Appl. No.: | **12/949,002** |
| Filed: | **Nov. 18, 2010** |

Related U.S. Application Data

(60) Provisional application No. 61/262,315, filed on Nov. 18, 2009.

(51) Int. Cl.
*F41C 23/14* (2006.01)
*F41C 23/04* (2006.01)

(52) U.S. Cl.
CPC ..... *F41C 23/04* (2013.01); *F41C 23/14* (2013.01)

(58) Field of Classification Search
None
See application file for complete search history.

(56) References Cited

To view the complete listing of prior art documents cited during the proceeding for Reexamination Control Number 90/013,631, please refer to the USPTO's public Patent Application Information Retrieval (PAIR) system under the Display References tab.

*Primary Examiner* — Jeffrey R Jastrzab

(57) ABSTRACT

A handle (20) for rapidly firing a semi-automatic firearm (22) having a trigger (24). The handle (20) includes a grip portion (52) defining a channel (54). A block (60) that is connected to the firearm (22) is slidably disposed in the channel (54) for allowing longitudinal movement of the firearm (22) relative to the handle (20). The handle (20) also includes a trigger guard (66) disposed on one side of the trigger (24) and extending longitudinally forward of the trigger (24) by a predetermined distance (D) to an open end. The trigger guard (66) presents a finger rest (70) for placing a trigger finger (74) on the trigger guard (66). The trigger guard (66) restricts access to the trigger (24) until the firearm (22) is moved longitudinally forward by the predetermined distance (D) relative to the handle (20). The handle (20) also includes a lock (44) having an open position for allowing longitudinal movement of the firearm (22) relative to the handle (20) and a locked position for restricting longitudinal movement of the firearm (22) relative to the handle (20).

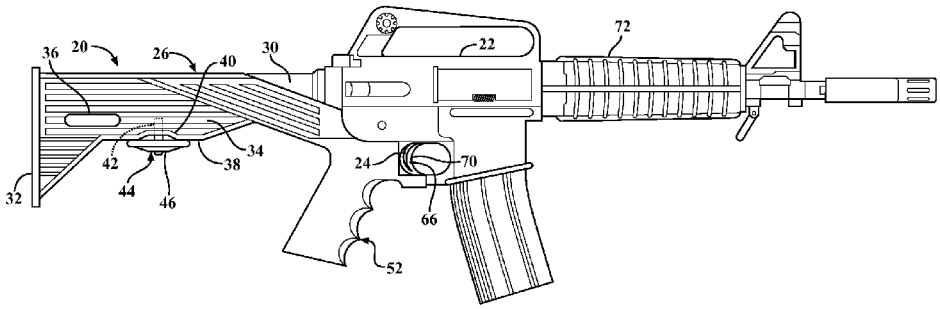

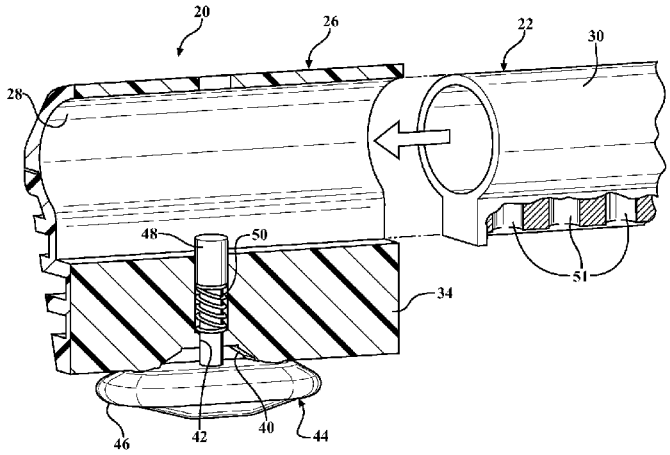

EX PARTE REEXAMINATION CERTIFICATE

NO AMENDMENTS HAVE BEEN MADE TO THE PATENT

AS A RESULT OF REEXAMINATION, IT HAS BEEN DETERMINED THAT:

The patentability of claims 1-23 is confirmed.

* * * * *